United States Patent [19]

Kulpa et al.

[11] 4,354,672

[45] Oct. 19, 1982

[54] SHEET STACKING AND ALIGNING APPARATUS

[75] Inventors: Walter J. Kulpa, Norwalk; John R. Paulik, Newtown, both of Conn.

[73] Assignee: Pitney Bowes Inc., Stamford, Conn.

[21] Appl. No.: 244,413

[22] Filed: Mar. 16, 1981

[51] Int. Cl.[3] ..... B65H 31/36

[52] U.S. Cl. ..... 271/221

[58] Field of Search ..... 271/221, 222, 146, 210

[56] References Cited

U.S. PATENT DOCUMENTS 1,845,384 2/1932 Zebelean ..... 271/222

3,441,268 4/1969 Hanson ..... 271/210

4,318,541 3/1982 Nagel ..... 271/222

*Primary Examiner*—Richard A. Schacher

*Attorney, Agent, or Firm*—Martin D. Wittstein; William D. Soltow, Jr.; Albert W. Scribner

[57] ABSTRACT

In a receiving tray for sheet document material, a jogging apparatus is included to cause registration of the sheets to one or more registration walls. The jogging apparatus is comprised of an elongated strip of flexible material which is fastened to the structural framework of the tray, while being deflected from at least one end to form bow-shaped waves which engage the edges of the sheets in order to urge the sheets towards the registration wall.

5 Claims, 6 Drawing Figures

SHEET STACKING AND ALIGNING APPARATUS

BACKGROUND OF THE INVENTION

The present invention relates to the stacking and alignment of sheet document material which has been processed in office machines. Typically, documents of various types and sizes are fed through office machines, in which the documents are subjected to many different processing techniques.

Within an office copying machine for example, the original document or documents are handled by automatic sheet feeding apparatus located on, or over the document illumination platen of the copier. The sheet feeding apparatus may vary in complexity in the sense that it may be fully automatic, semi-automatic, or of a stream feeding nature. The simplist typical stream-fed document feeder apparatus for example will receive and feed single, hand-fed documents which are loaded one at a time. The semi-automatic feeders will accept a stack of documents, and will feed the documents automatically, one at a time from the stack, one time over the platen, while feeding the scanned documents into a receiving tray. The fully automatic document feeder can accept a stack of documents, separate and feed each document one at a time until the entire stack has been fed unto the platen, while simultaneously restacking the previously scanned documents in the same order, into the tray from where they were originally fed. This operation may be repeated for as many times as required to generate as many sets of documents as are required.

While the office copying machine may be equipped with original document handling apparatus such as those described, the typical copier also has copy sheet feeding apparatus included with its internal instrumentalities to facilitate a sheet feed from a supply stack and to accomplish reception of transfer of the developed image of each original unto that sheet. Thus, for each original document fed unto the illumination platen, a corresponding sheet is available for the purpose of receiving an image transfer as often as required. Typically, the copier has a photoconductor which receives the projected image of indicia illuminated from each original document. The process of the copier includes instrumentalities for preparation of reception of the image unto the photoconductor, and also development and transfer of the latent image to the copy sheet. In many copiers with a dry powder development process, the powder electrostatically attracts to the exposed image on the photoconductor, and is then further electrically forced to transfer from the photoconductor to each copy sheet.

Copy sheets thus provided with a transferred image are transported through the copier machine to a fusing station, just prior to being delivered to the operator.

In most cases, consideration is given for separately stacking the original documents and the copy sheets feed through the copier in receiving tray. The trays serve to stack and regroup the documents for operator convenience. It may also be necessary to register and align edges of the documents and sheets in the stacking and regrouping process to facilitate further processing in auxiliary document handling equipment.

Such auxiliary sheet processing equipment exists in the nature of collating or sorter machines which may be used to automatically group and sort documents provided from the copier output. An example of such equipment is described in U.S. Pat. No. 4,146,215, issued Mar. 27, 1979 to Hans C. Mol.

The collator-sorter disclosed in the Mol patent describes the workings of a sheet processor that may be utilized as either a collator or sorter. The collator-sorter may be used separately or coupled with a copier. The device has the ability to function as a single tray receiver for sheets, or by using the multi-bin receiving compartments can handle the sheets as a sorter. There are included, gating devices which direct the sheets where required into appropriate bins. To further compliment this type of collator and sorter equipment, it is desirable that a document jogger mechanism be included to provide squared, registered stacks in the receiving bins for operator convenience.

A jogging device for documents is disclosed in U.S. Pat. No. 4,073,391 to O'Brien and Calderazo Feb. 14, 1978. The jogger provides apparatus to square the documents into a bundle, and is augmented by a stapling device, also provided for convenience. After stapling, the bundle is discharged into a receiving bin, where a separate mechanism is provided to offset each bundle for easy handling and identification.

While the previously described document stacking, jogging and bundling equipment is advantageously applied to document sheet material, the equipment described is provided in separate machines, some of which have to be used in a remote, inconvenient manner from the office machines documents are circulated, scanned and stacked and delivered. Basically, the prior art described henceforth does not provide convenient means to compactly apply jogging and registration alignment for documents fed into stacking trays such as those included in the latest available table top copying machines.

PRIOR ART

U.S. Pat. No. 3,350,091 to E. E. Masterson et al. issued on July 9, 1965 discloses means including a reference guide rail, with separate resilient aligning means disposed on the opposite side, to facilitate registration and alignment of records against the rail as the documents are fed from a processing system. The document records are forwardly translated by cooperating feeding rollers which are constructed with axially resilient means included within the rolls, in order to allow a lateral side thrust to be imposed on the forwardly translating documents. The side thrust is provided by several flat springs, which are mechanically actuated, engage the edge of the forwardly moving record on that edge of the record opposing the register guide rail.

U.S. Pat. No. 3,361,426 to F. F. Pawlikowski et al. issued Jan. 2, 1968, discloses jogging means for providing alignment of newspapers being conveyed to an assembly or stacking station. The apparatus includes a conveyor and a pair of upstanding side plates which move inwardly and outwardly so as to align the newspapers against a reference edge while the newspapers are advanced by the conveyor.

U.S. Pat. No. 3,972,525 issued to Dean Harold Foster on Aug. 3, 1976 discloses means for sheet jogging at a sheet receiving station. The device operates on the rear edge of the sheets after they are deposited on a receiving tray. The apparatus includes means for adjustment to accommodate different lengths of sheets ranging from 7 to 14 inches.

U.S. Pat. No. 3,910,568 issued to Michael A. Brown and Frank Chiapetta on Oct. 7, 1975 discloses sheet jogging apparatus for accommodating plural receiver bins. The jogging apparatus engages one side edge of all sheets in all bins having sheets, and provides urging to register those sheets in a predetermined position in each bin.

SUMMARY OF THE INVENTION

The present invention generally relates to sheet stacking and aligning apparatus in which a sheet receiving tray is adapted to receive successively fed sheets. The tray has a bottom wall, and an abutment in the path of movement of the sheets for arresting forward movement of the sheets. There is a registration wall disposed adjacent one side edge of the bottom wall, and jogging means disposed adjacent the opposite side edge of the bottom wall for urging the sheets towards and against the registration wall.

The jogging means is comprised of an elongate strip of flexible material which extends along the edge of the sheets which is opposite to the registration wall. The elongated flexible strip has connective means for permitting at least one end of the strip to move with substantially limited linear movement to cause the strip to bow towards the side edge of the sheets for the purpose of engaging and urging the sheets towards the registration wall.

OBJECTS OF THE INVENTION

It is an object of the present invention to provide an improved jogging mechanism for sheets fed into a receiving tray.

It is a further object of the present invention to provide jogging means which may be applied to one or more edges of a stack of sheets to effect registration thereof.

A still further object is to provide a jogger device formed of a flexible ribbon member which may be actuated from one or more ends.

Another object is to provide a jogging device which retards motion of the sheets being stacked so as to reduce rebound from the forward restraining abutment.

DESCRIPTION OF THE PREFERRED EMBODIMENT

Figure 1:
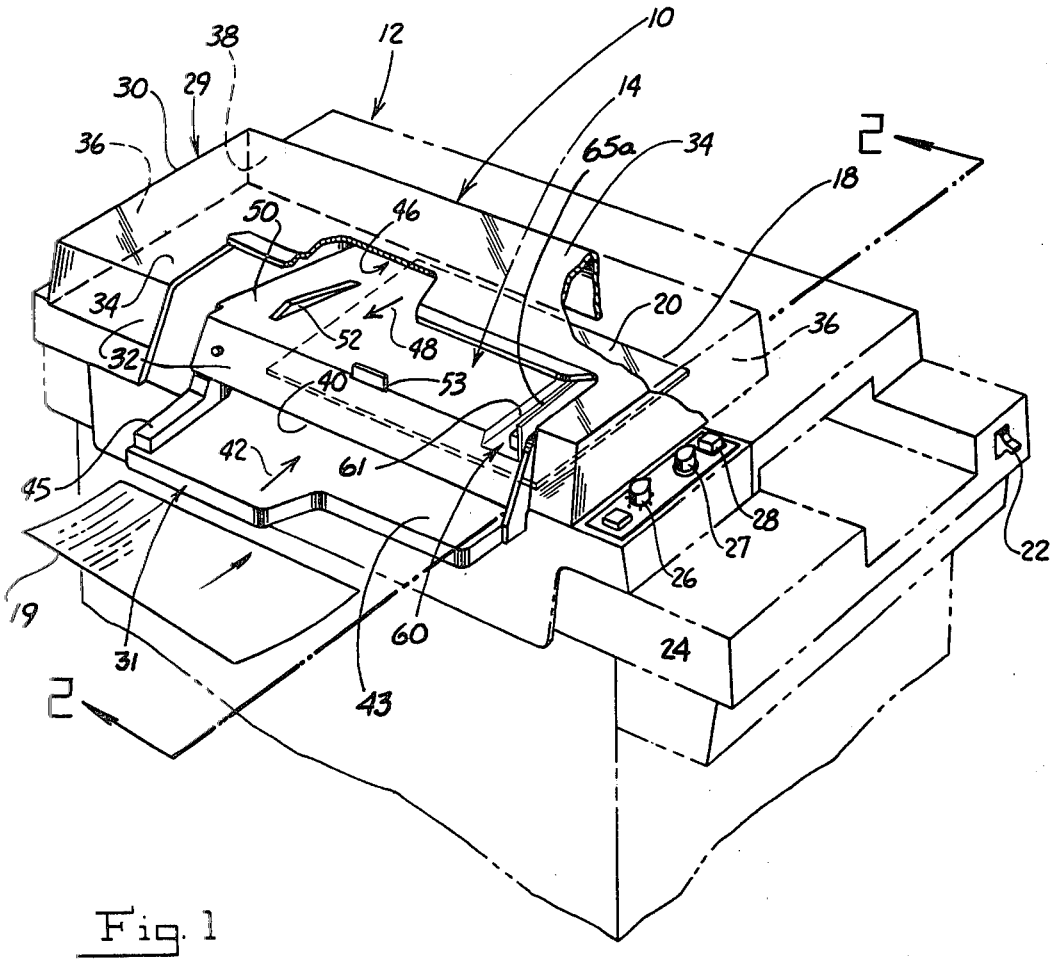
FIG. 1 is a fragmentary perspective view of a copier including a document feeder.
Figures 3, 3A:
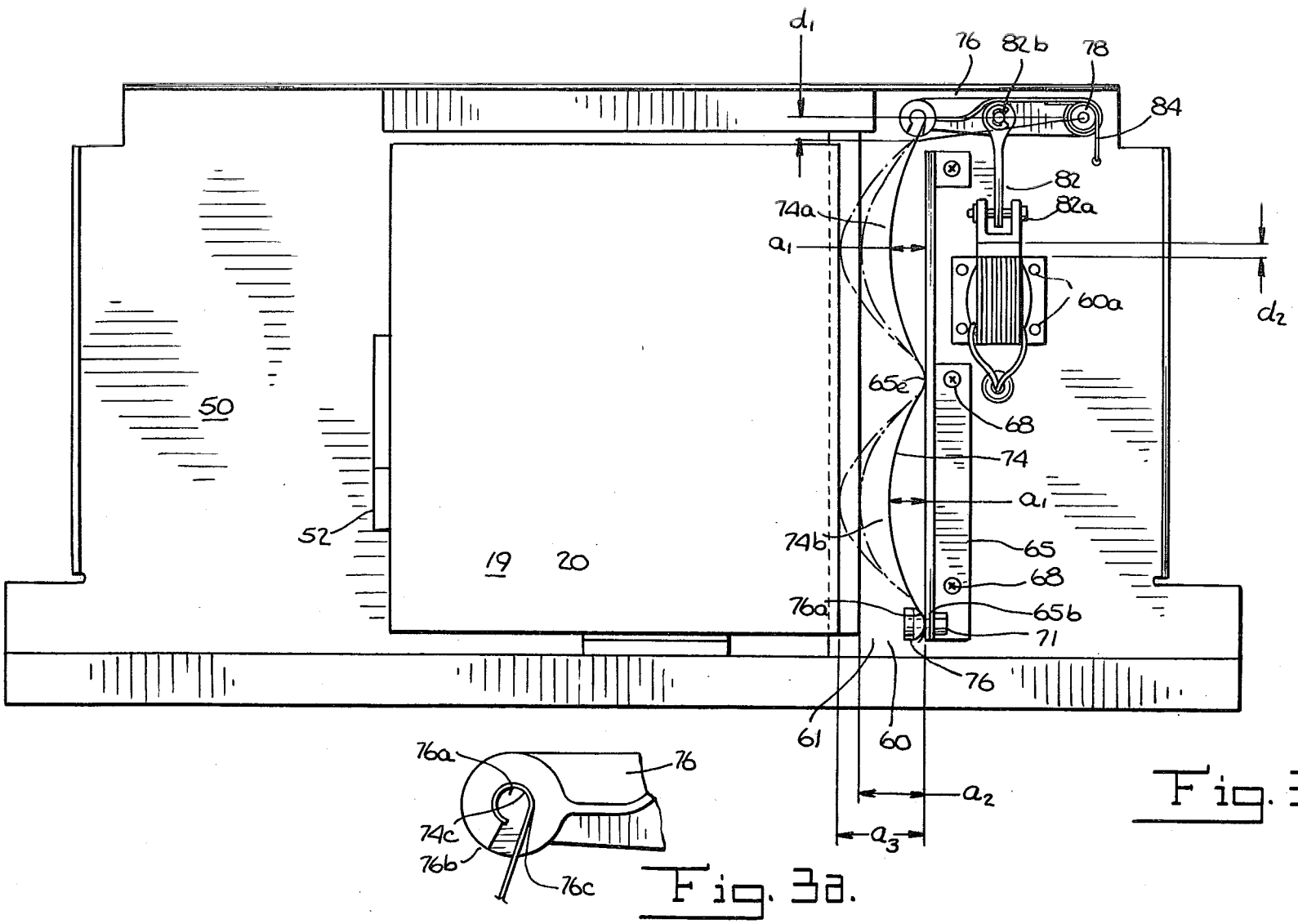
FIG. 3 is a partial plan view of the document feeder of FIG. 2 with the uppermost covers substantially off showing the preferred embodiment of the invention.
FIG. 3*a* is an enlarged view taken substantially in the same direction as FIG. 3, showing one end portion of the flexible urging member.

As shown in FIG. 1, a document feeder 10 is suitably removably mounted on a copier 12 over the document illuminating station 14. The copier 12 has suitable supporting structure, for the various processing apparatus associated with the copier 12, as well as a glass platen 18, (FIG. 3). The glass platen 18 supports graphic information which is appropriately illuminated, and optically transposed to the processing apparatus internal to the machine.

The processing apparatus includes a photoconductor member and various instrumentalities for preparing the photoconductor, in order to receive the original image. There are also developing means included and various copy sheet transport devices all of which are not shown, but understood to present the typical workings of a copier. In addition, the processing means includes suitable, well-known instrumentalities for controlling the process sequence of the copier (FIG. 1) including a main power switch 22. Also, there is provided a print switch 24 for initiating a copying cycle, a first selector switch 26 for choosing the number of copies desired, a second selector switch 27 for adjusting the dark/light concentration of the image on the copy sheet and a resettable stop print switch 28.

The document feeder 10 (FIG. 1) comprises an upper housing 29 including a cover 30, and a frame 31 on which the cover 30 is removably mounted. The cover 30 includes a front wall 32, top wall 34, opposed side walls 36 and a rear wall 38.

The front wall 32 and frame 31 form a document entry aperature 40 (FIG. 1), into which successive documents 19 (FIG. 1) are individually fed by an operator. The documents 19 are inserted in the direction of arrow 42, (FIG. 1), and the documents are guided by hand unto a lower platform 43, which extends into the document feeder, in a plane aligned with the illumination platen 18. The documents are manually guided into feeder throat 40 while also edge aligned with a suitable adjustably fixed registration abutment wall 45.

Figure 2:
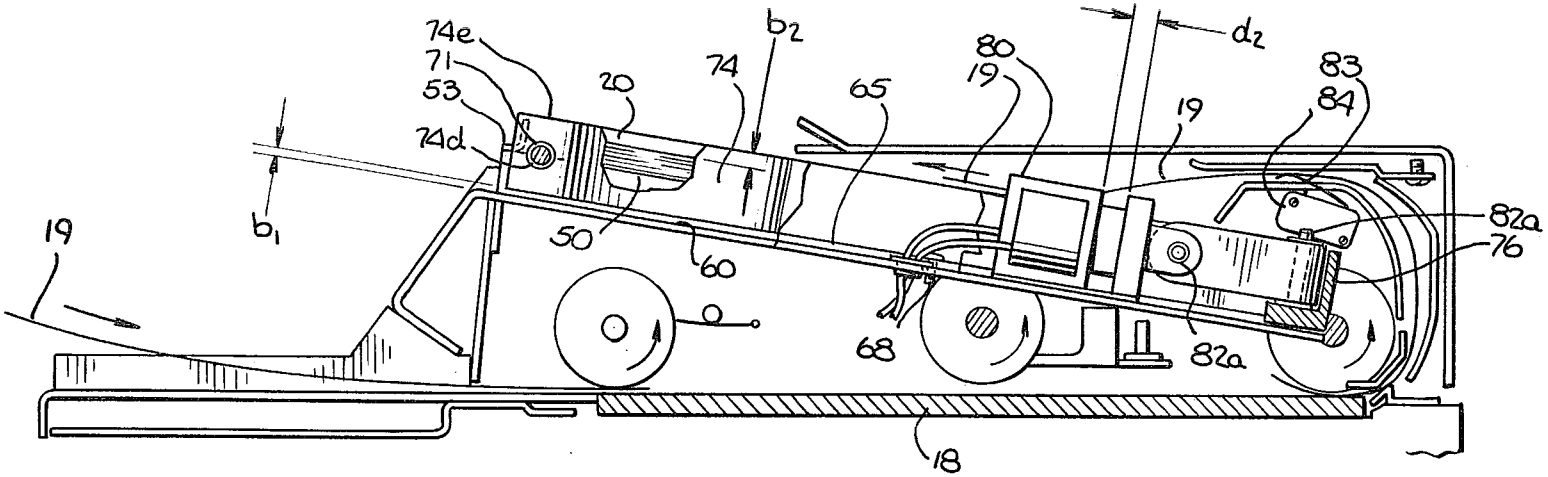
FIG. 2 is a partial sectional view generally taken through 2—2 of the document feeder of FIG. 1.

The top wall 34 (FIG. 1) has a document exit aperture 46 which permits each successively fed document 19 to return to the machine operator at the front of the copier 12. Successive documents 19 (FIG. 1), are accepted by the feeder 10 at the illumination station 14, and are fed by the instrumentalities within feeder 10 outwardly back towards the machine operator in the direction of the arrow 48. In addition, the top wall 34 (FIG. 1) includes a ramp-like upper document receiving platform 50, to which the documents 19 exit and stack unto, after traveling through the aperature 46. To arrest the forward motion of the exiting documents 19, an upright abutment 53 is provided at the forward end of the platform 50. In addition, an upright side registration wall 52 projects from the platform 50. The registration wall 52 serves principally as a document end edge guide, as well as a registration abutment for each document 19 or a stack (20) of documents (FIG. 2).

The feeder 10 thus described generally is a stream feeding type, which accommodates manually fed documents 19 fed through the inlet aperature 40 (FIG. 1).

For a further detailed description of the preferred embodiment of the document feeder 10, refer to U.S. Pat. No. 4,110,038 issued to Robert Irvine, Harry E. Luperti, and Robert E. Manna on Aug. 29, 1978. Otherwise, it will be generally understood to those skilled in the art that the document feeder 10 has instrumentalities, including document feed, registration control means and document sensing devices which communicate and operate with the copier 12 as documents 19 are fed seriatim into feeder 10.

Generally, the present invention is included as an extension of the document feeder 10, and is appropriately located within the feeder 10 parameter as enclosed by cover 30. A recessed platform 60, (FIG. 1) (which is structurally part of the sheet receiving platform 50), is provided and located parallel and slightly lower than platform 50. Platform 60 is also located on the side of feeder 10 which is opposite to the upright registration wall 52.

The recessed platform 60, forms the general local assembly area 61 in which the instrumentalities of the present document jogging invention function. The recessed platform 60 is located and positioned in order that it partially underlies an edge of a document 19, or a stack of documents 20 (FIG. 3), lying upon receiving platform 50.

Mounted on the recessed platform 60, there is provided a right angle support bracket 65 (FIG. 3), which is rigidly fastened to the platform 60 by means of screws 68 (FIG. 3). Located near the forward end of the feeder 10, and through the bracket 65 there is provided a hole **74*d* (FIG. 2), in the upright leg 65*a* of the bracket 65, for accommodating a screw 71**.

Also, in FIG. 3 a flexible member 74 is shown with several preformed waves **74*a* and 74*b* of substantially the same amplitude "a". The forward end of the member 74 also has a hole 65*b* to accommodate screw 71, and thus, member 74 is rigidly assembled to the upright leg 65*a* bracket 65 so that the member 74 is positioned adjacent to the edge of a document 19, or stack of documents 20 having been received upon platform 50. For the purposes of clamping member 74 rigidly to the bracket leg 65*a*, there is provided a nut 76 (FIG. 3), having a cylindrical radius 76*a*. The cylindrical radius 76*a* accommodates the wave 74*b* deflection during the document 19 urging process. The radius 76*a* also reduces any possibility of fatigue stress upon member 74, due to repeated flexure. There is provided a nut 76 having a cylindrical radius 76*a* which is assembled over member 74**.

The opposite actuatable end of flexible member 74 is rolled into a small partial cylindrical shape **74*c*** (FIG. 3*a*), that fits into a cavity **76*a* of molded solenoid lever arm 76 with sufficient clearance at 76*b* and 76*c* accommodate repeated deflection of member 74. Arm 76 is pivotably mounted on platform 60 by means of a shoulder screw 78. There is also provided an electromechanical actuator 80, which is rigidly secured to platform 60 by screws 60*a* (FIG. 3), and the actuator 80 is further connected to arm 76 through connecting link 82 and accommodating connecting pins 82*a***.

Actuator 80 is caused to operate at a predetermined delayed time after the leading end of a document 19 enables switch 84 through engagement with switch actuator arm 83, (FIG. 2). At that time, the actuator 80 pulls connecting link 82, and the lever arm 76 which through all previously described connections then causes the swivel end **74*c* of the flexible member 74** to move forwardly through a predetermined limited substantially limited distance "$d_1$".

The member 74 is resiliently biased into the rest position in which the preformed waves **74*a* and 74*b* are each at a reduced amplitude "$a_1$". Depending on the need and circumstance for urging material towards a registration abutment, it should be pointed out that it is possible to have member 74 fabricated from material so that it may be flatly shaped, thereby eliminating the preformed waves 74*a* and 74*b*. In this case, a single wave may be satisfactory to accomplish the urging process for the sheets, and the member 74 will easily accommodate a single wave. A torsion spring 84 provides resilient means for biasing the flexible member 74, and all connected members described heretofor. The spring 84 is appropriately secured to lever arm 76 and platform 60**.

When the flexible member 74 is pushed forward by arm 76 through distance "$d_1$" (FIG. 3), waves **74*a* and 74*b* increase in amplitude until they reach a predetermined height "$a_3$". During the total deflection of the waves 74*a* and 74*b*, the crests of each respective wave initially engage the end edge of any unregistered or skewed document 19 or stack of documents 20, after having deflected to dimension "$a_2$". The waves 74*a* and 74*b* continue to deflect and increase in amplitude until the edge of the sheets 19 are finally urged through a total final deflection "$a_3$". It has been found that a reasonable total deflection $a_3$ is 1" while a reasonable starting deflection (preformed) wave 74*a* and 74*b***, has been found to be in the order of 0.50".

It will be recognized by those skilled in the art, that the predetermined values of a "$a_1$", "$a_2$" and "$a_3$" in respect to the lateral end-to-end size of the sheets being registered on the stacking platform 50 are in a given related relationship with respect to the document length. This length relationship, upon need, may be easily changed by providing an operator adjustable, lateral shift of the upright registration wall 52. An adjustment of wall 52, would accommodate for instance the legal 14" document length.

In the description of the embodiments of the present invention, a standard letter size document 19, $8\frac{1}{2}\times 11$ is considered within the text of this specification. However, if urger 74 is used along the width of the paper $8\frac{1}{2}$" wide and A4 paper can be accommodated without adjustment, member 74 will accommodate the usual variation in paper size due to tolerances and humidity without requiring adjustment.

It is important that urging member 74 be allowed to flex freely, and best seen in (FIG. 2), there is provided a space "$b_1$", which ensures the free flexure. Referring to FIG. 2, the space "$b_1$", is thus provided between the bottom most edge of member 74, and the top of platform 60. Also best seen in FIG. 2, there is shown an overlap "$b_2$" of the previously stacked documents 20, with respect to the top edge **74*e* of member 74. The overlap "$b_2$" is somewhat dependent on the document 20 stack height, which in turn is dependent on the amount of documents 19 fed at any given time by one machine operator. In any case, a reasonable amount of overlap, for example 0.250 inches, will ensure that all documents 20 are continuously urged toward the abutment edge 52**.

Figure 4:
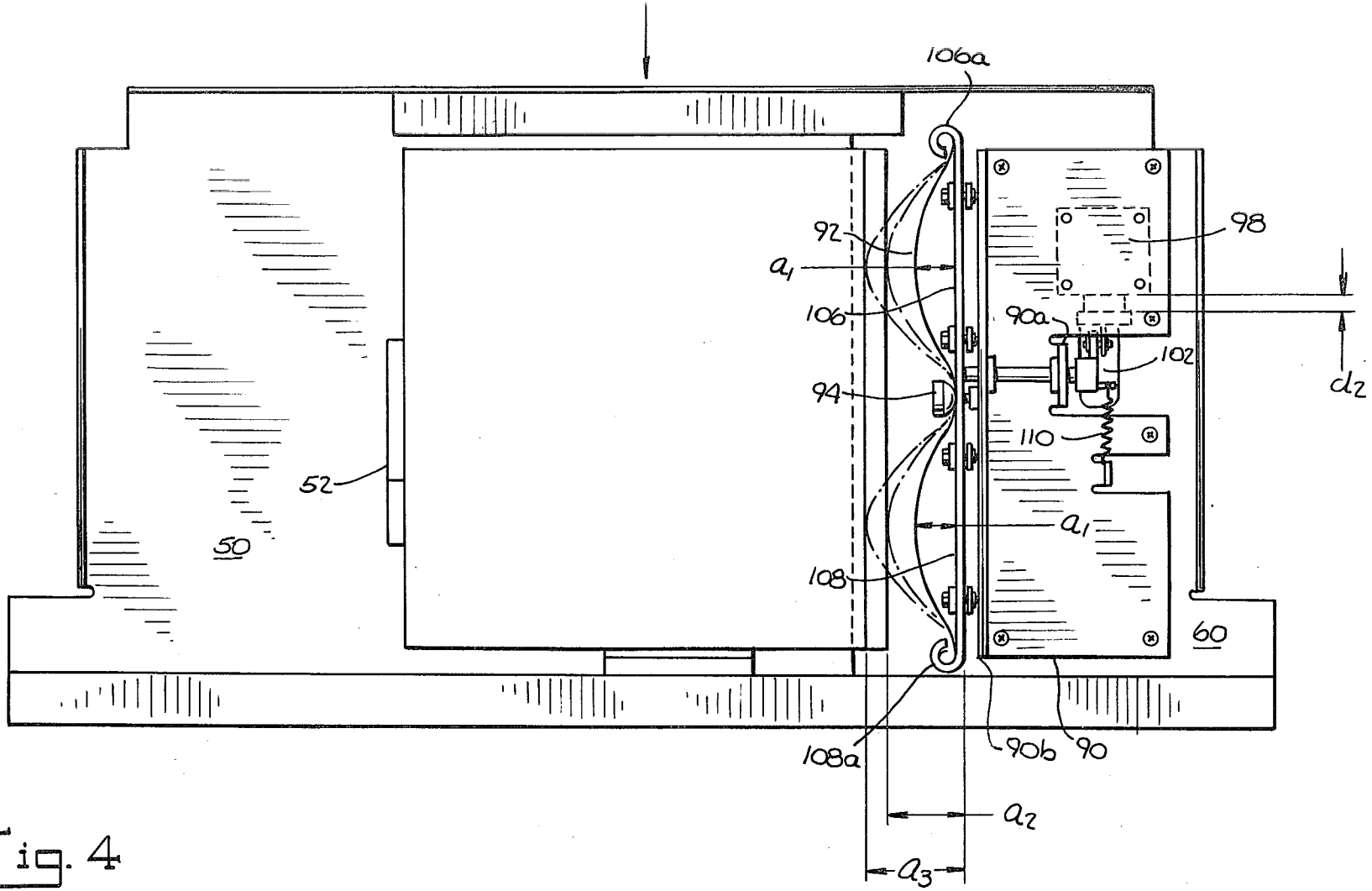
FIG. 4 is a partial plan view of the document feeder of FIG. 2, with the uppermost covers substantially off showing a second embodiment of the invention.
Figure 5:
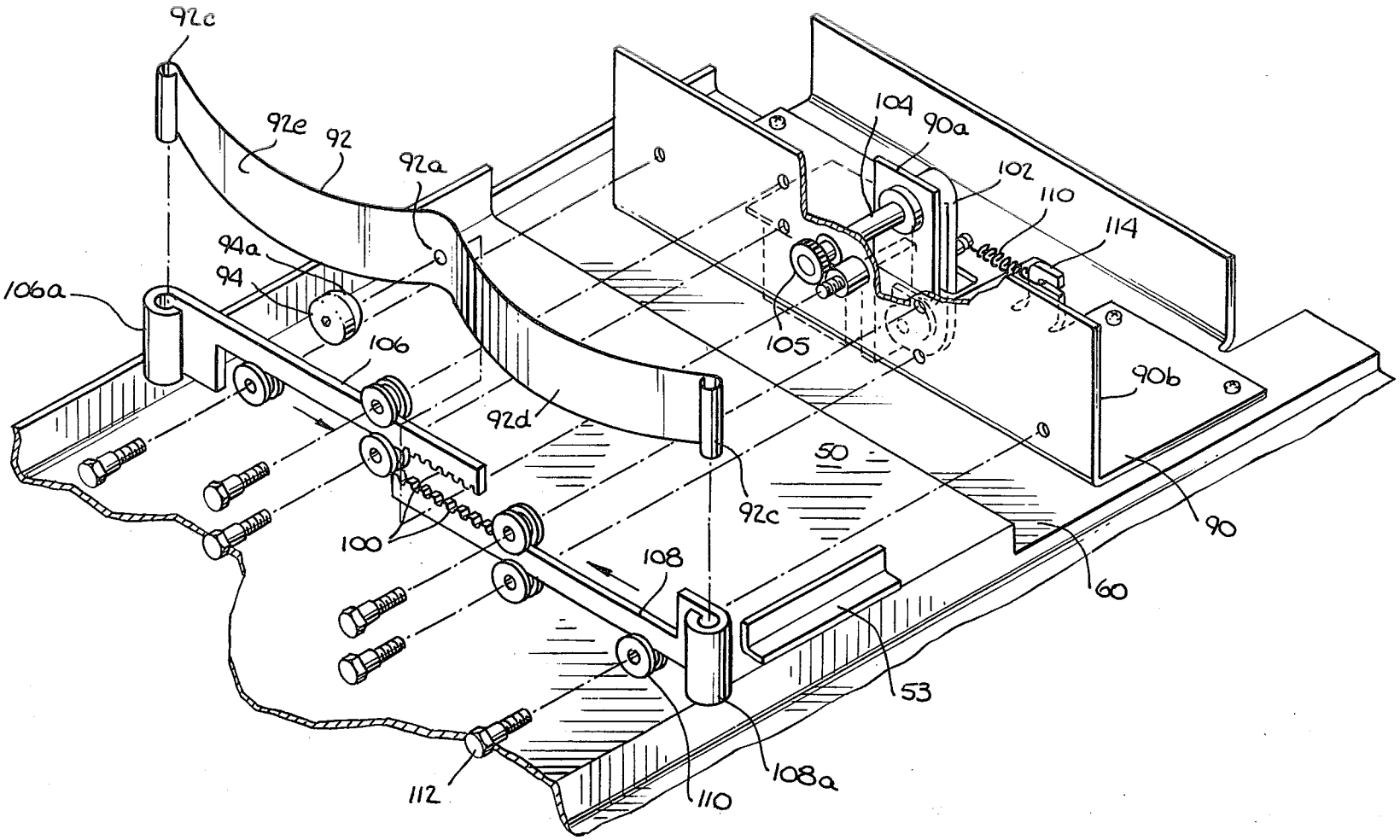
FIG. 5 is a partial exploded perspective view of the second embodiment of the invention shown in FIG. 4.

A second embodiment of the invention is shown in FIGS. 4 and 5, in which the urging member 92 is deflected simultaneously from both ends **92*c***.

Motion is provided by an apparatus movably attached to a power actuator 98. The actuator 98 provides motion "$d_2$" (FIG. 4), for rotational movement of all apparatus connecting actuator 98 with pinion gear 105.

Referring to FIG. 2, document sensing switch 84 has an actuator arm 83 which is enabled by the leading edge of a document 19 being ejected from feeder 10. Actuation of switch 84 causes activation of the urging member 92 in a manner similar to that previously described in the preferred embodiment.

There is a predetermined delay time after switch 84 actuation, after which power actuator 98 (FIG. 5) is enabled. The actuator 98 pulls in through a distance "$d_2$", thereby through suitable pinned connections to lever arm assembly 102, rotates arm 102 and consequently shaft 104. Shaft 104 is rotatably supported in suitable journals provided in the upright leg 90*a* of bracket 90, and also in upright flange 90*b*. The opposite end of the shaft 104 supports gear pinion member 105, suitably connected thereto, so that pinion 105 simultaneously engages the upper and lower rack members 106 and 108 at rack teeth 100. The initial motion "$d_2$" provided by actuator 98 is thus converted to rotary motion, and back to lineal motion for the purpose of pulling the ends 92*c* of member 92 towards each other.

Best seen in FIG. 5, there are provided racks 106 and 108, which are slidably supported by typical rollers 110, all of which are rotatably mounted on typical shoulder studs 112. The studs 112 are all secured appropriately to the flange 90*b* of the support bracket 90.

Urging member 92 is clamped at its center (FIG. 5), to the upright leg 90*b* of the bracket 90. A screw 96 is provided as the fastener, which clamps means against a spacer 97 suitably adopted to fit the screw 96. There is also provided a nut 94 which has a cylindrical radius 94*a*, which allows the urging member 92 to deflect freely, while also clamping the member 92 rigidly.

The rack members 106 and 108 are made of any suitable material cast, formed or molded which is capable of confining the ends 92*c* of member 92 in pocket-like receptacles 106*a* and 108*a*. Similar to the preferred embodiment, the urging member 92 deflects so that the preformed waves 92*d* and 92*e* buckle and urge the edge of sheets advanced unto platform 60. The amplitude is also similar in height with respect to the preferred embodiment, where a total deflection of 1" is sufficient to provide the required movement to urge all documents to the abutment edge 52.

In both embodiments, the upright legs 65*a* and 90*b* of the supporting brackets 65 and 90 respectively, tend to support the urging members 74 and 92. Especially in the first embodiment (FIG. 3), where the member 74 is sliding along bracket leg 65*a* at 65*e* during the urging motion.

While several embodiments of the invention have been disclosed herein, it will be obvious to those skilled in the art that many changes may be made in the size, shape, detail and arrangements of the various elements of the invention captured within the spirit and scope of the following claims.

What is claimed is:

1. A sheet stacking and aligning apparatus comprising:

A. means defining a sheet receiving tray adapted to receive sheets successively from a feeding apparatus, said tray comprising at least a bottom wall and an abutment in the path of movement of the sheets for arresting forward movement of the sheets, B. registration means disposed adjacent one side edge of said bottom wall against which the sheets are urged for lateral alignment of the sheets, C. jogging means disposed adjacent the opposite side edge of said bottom wall for urging said sheets toward and against said registration means, said jogging means comprising, (1) an elongate strip of flexible material extending along said opposite side edge of said bottom wall and, (2) means for causing said strip to bow towards the side edge of the sheets in at least one location along the length of said strip when one end of said strip is moved toward the other end to form at least one wave having an amplitude such that the crest of said wave engages the side edge of each sheet for urging said sheet toward and against said registration means, and, D. means for moving at least one end of said strip toward the other end thereby causing said strip to bow and form said wave.

2. Apparatus according to claim 1 wherein said strip is fixedly mounted at one end thereof to said apparatus and said moving means is connected to the other end of said strip.

3. Apparatus according to claim 2 wherein said moving means comprise an actuator having means for causing limited substantially linear movement of said other end of said strip in a direction along the longitudinal axis of said strip.

4. Apparatus according to claim 1 wherein said strip is fixedly connected at its mid-point to said apparatus and said moving means is connected to opposite ends of said strip.

5. Apparatus according to claim 4 wherein said moving means comprises an actuator having means for causing limited substantially linear movement of both said opposite ends of said strip toward each other substantially simultaneously and by substantially the same distance.

* * * * *